US006273749B1

(12) United States Patent
Yang

(10) Patent No.: US 6,273,749 B1
(45) Date of Patent: Aug. 14, 2001

(54) CONNECTOR

(75) Inventor: George Yang, Shih-Lin District (TW)

(73) Assignee: All Best Electronics Co., Ltd., Taipei (TW)

( * ) Notice: Subject to any disclaimer, the term of this patent is extended or adjusted under 35 U.S.C. 154(b) by 0 days.

(21) Appl. No.: 09/522,259

(22) Filed: Mar. 9, 2000

(51) Int. Cl.[7] ..... H01R 9/07
(52) U.S. Cl. ..... 439/497; 439/579
(58) Field of Search ..... 439/492, 493, 439/494, 495, 497, 498, 499, 579, 630, 634, 636

(56) References Cited

U.S. PATENT DOCUMENTS 4,679,868 * 7/1987 Hasircoglu ..... 439/495
5,967,832 * 10/1999 Ploehn ..... 439/497
5,993,247 * 11/1999 Kidd ..... 439/495
6,007,371 * 12/1999 Hickox ..... 439/499

* cited by examiner

*Primary Examiner*—Lincoln Donovan
*Assistant Examiner*—Thanh-Tam Le
(74) *Attorney, Agent, or Firm*—Pro Techtor International Service

(57) ABSTRACT

A connector includes a plastic body, a front part of which is covered with a steel case and a rear part of which has an insertion plate connected thereto. A common ground connection means is associated with a rear side of the insertion plate by locating staggered upper and lower common ground terminals at the front edge of the common ground connection means in some of the terminal slots on the insertion plate to thereby electrically contact with rear ends of connection terminals provided on the plastic body and seated in the same terminal slots. Ground wires in multiple-core cables are connected to the terminal slots that have both the common ground terminal and the connection terminal seated therein and other information wires in the multiple-core cables are connected to the terminal slots that have only the connection terminal seated therein. Thereby, noise interference may be effectively reduced and transmission speed may be increased.

3 Claims, 5 Drawing Sheets

A – A′

CONNECTOR

BACKGROUND OF THE INVENTION

The present invention relates to a connector, and more particularly to a connector that includes a common ground connection means to have all ground wires connected thereto and therefore effectively reduces noise interference and protects good data transmission.

Connectors that are widely used with computers and video products generally include a steel case and a plastic body. The steel case covers a front part of the plastic body. The plastic body is provided at rear outer surfaces with two rows of connection terminals, rear ends of which are connected to a flat cable via a link plate. Connectors with such type of structure are large and occupy increased space, and are usually used with general desktop computers. The use of the link plate to connect the signal wires to the connection terminals also reduces the transmission speed. Another problem with the conventional connectors is they have separate ground wires that form multiple noise interference sources.

To solve these problems, there is developed a connector having a link plate for transferring signals. FIG. 1 is an exploded perspective of such conventional connector. As shown, the connector includes a steel case 1, a plastic body 2, and a link plate 3. The steel case 1 covers a front part of the plastic body 2 and the link plate 3 is connected to a rear part of the plastic body 2.

The plastic body 2 is provided at the rear part with upper and lower staggered connection terminals 21 that extend rearward from the plastic body 2. Two side walls of the plastic body 2 extend rearward and have a guide groove 23 provided at their respective inner wall surface. Each guide groove 23 is provided with a retaining hole 24.

The link plate 3 is provided at two lateral sides with retaining projections 31 corresponding to the retaining holes 24 in the guide grooves 23 of the plastic body 2, so that the link plate 3 may be slid into the guide grooves 23 to locate therebetween and be retained in place by engagement of the retaining projections 31 into the retaining holes 24. The link plate 3 is provided at upper and lower front surfaces with contacts 32 corresponding to the connection terminals 21 on the plastic body 2, and at a rear side with a bus-bar socket 33 for a plug 41 of a bus bar 4 to insert thereinto. When the link plate 3 is inserted to the rear part of the plastic body 2, some of the contacts 32 on the link plate 3 electrically contact with the connection terminals 21 on the plastic body 2.

Bus wires in the bus bar 4 are arranged corresponding to positions provided in the bus-bar plug 41. The bus-bar plug 41 is plugged into the bus-bar socket 33, such that bus wires of the bus bar 4 separately correspond to the contacts 32 at the front side of the link plate 3 while the contacts 32 are electrically connected to the connection terminals 21 on the plastic body 2. Since the bus-bar plug 41 may be freely unplugged from the socket 33, the bus bar 4 could be replaced when necessary to permit repeated use of the connector.

Although the above-described conventional connector can be advantageously used, it still has the following drawbacks and therefore requires improvement:

1. Bus wires of the bus bar 4 are very thin and tend to break or bend when the bus-bar plug 41 is frequently plugged and unplugged in and from the socket 33. Any broken or bent bus wire in the bus bar 4 would cause poor electrical connection and necessitates replacement of the whole expensive bus bar 4 and that is apparently not economical.

2. The use of the link plate 3 as a signal communication interface in the connector for all data to be transmitted via the link plate 3 on the one hand prevents the whole connector from being miniaturized and on the other hand increases the data transmission distance to cause attenuation of signal and slowed transmission of data.

3. The existence of the link plate 3 contributes to increased possibilities of noise interference to cause confused system and troubles in use of the connector.

It is therefore desirable to develop a connector in which the link plate is omitted and replaced with an insertion plate and a common ground connection means, so that the connector has reduced volume and manufacture cost and is capable of providing increased transmission speed and isolating noise interference.

SUMMARY OF THE INVENTION

A primary object of the present invention is to provide an improved connector that includes a common ground connection means which is electrically connected to some connection terminals on the plastic body of the connector via an insertion plate, such that the connector has reduced volume and manufacture cost and is capable of providing increased transmission speed and isolating noise interference.

To achieve the above and other objects, the connector of the present invention mainly includes a plastic body, a front part of which being covered with a steel case and a rear part of which having an insertion plate connected thereto. The plastic body has two rearward extended side walls that are provided at an inner surface with a guide groove each, so that the insertion plate is connected to the plastic body by engaging two lateral sides into the two guide grooves. The insertion plate is provided at a front side with an upper and a lower row of multiple terminal slots in each of which a rear end of a connection terminal provided on the rear part of the plastic body is seated. The insertion plate is provided at a rear side with an upper and a lower receiving recess transversely extending across the insertion plate. The upper and the lower receiving recesses are electrically connected with rear ends of some of the terminal slots at the front side of the insertion plate. The connector of the present invention is characterized in that a common ground connection means is associated with the upper and the lower receiving recesses provided at the rear side of the insertion plate. The common ground connection means is provided at a front side with staggered upper and lower common ground terminals that are separately located in some of the terminal slots of the insertion plate to electrically contact with rear ends of the connection terminals correspondingly seated in those some terminal slots. The connector is also characterized in that a plurality of multiple-core cables are separately connected to the insertion plate in such a manner that a ground wire in each of the multiple-core cables is connected to those terminal slots that each has one common ground terminal and one connection terminal seated therein and other information wires in each of the multiple-core cables are connected to those terminal slots that each has only the connection terminal seated therein. Whereby all the ground wires are electrically connected to the common ground connection means to form a common ground that effectively reduces noises and prevents noise interference with the connector.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
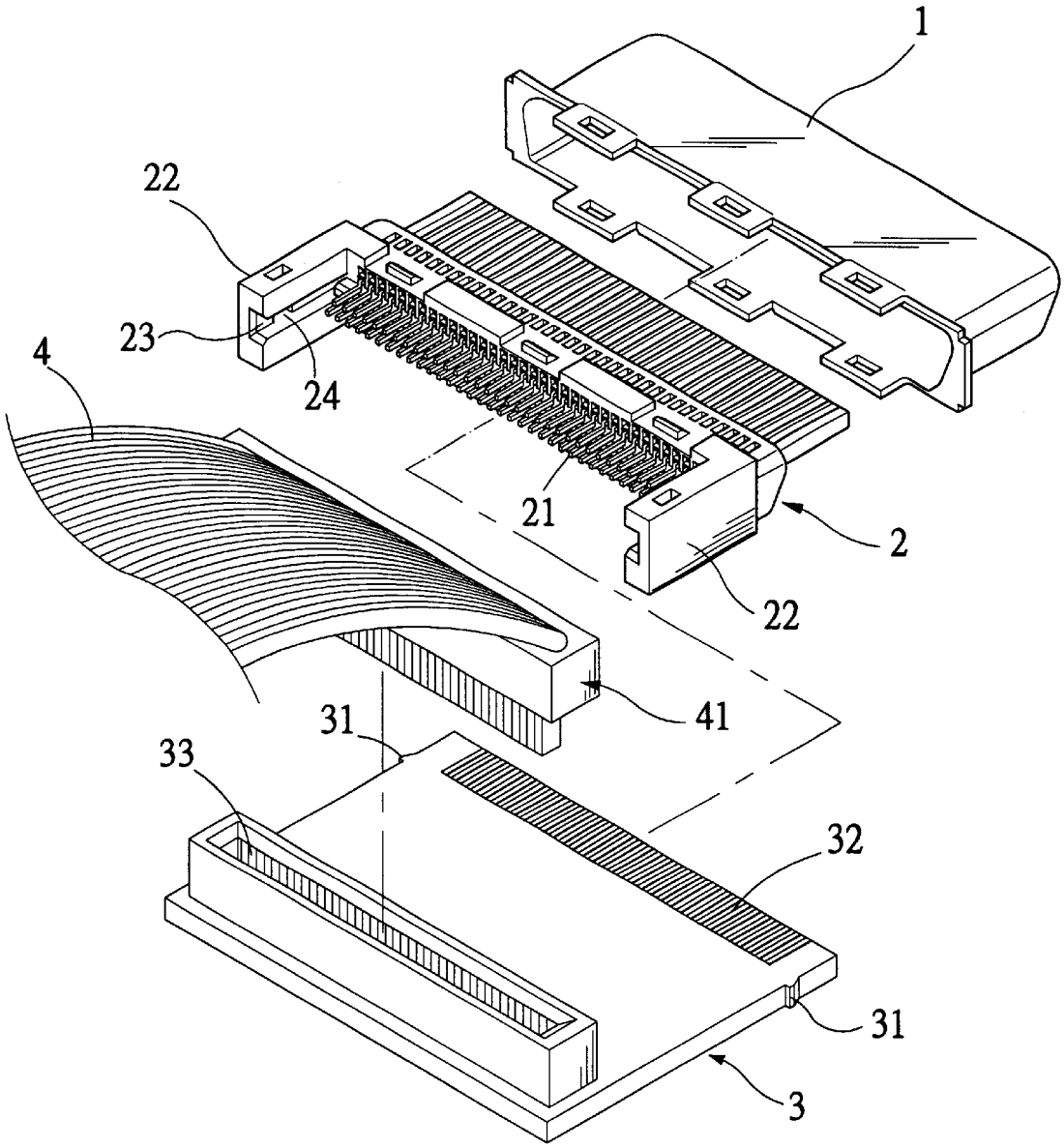
(PRIOR ART) Fig.1
FIG. 1 is an exploded perspective showing the structure of a conventional connector.
Figure 2:
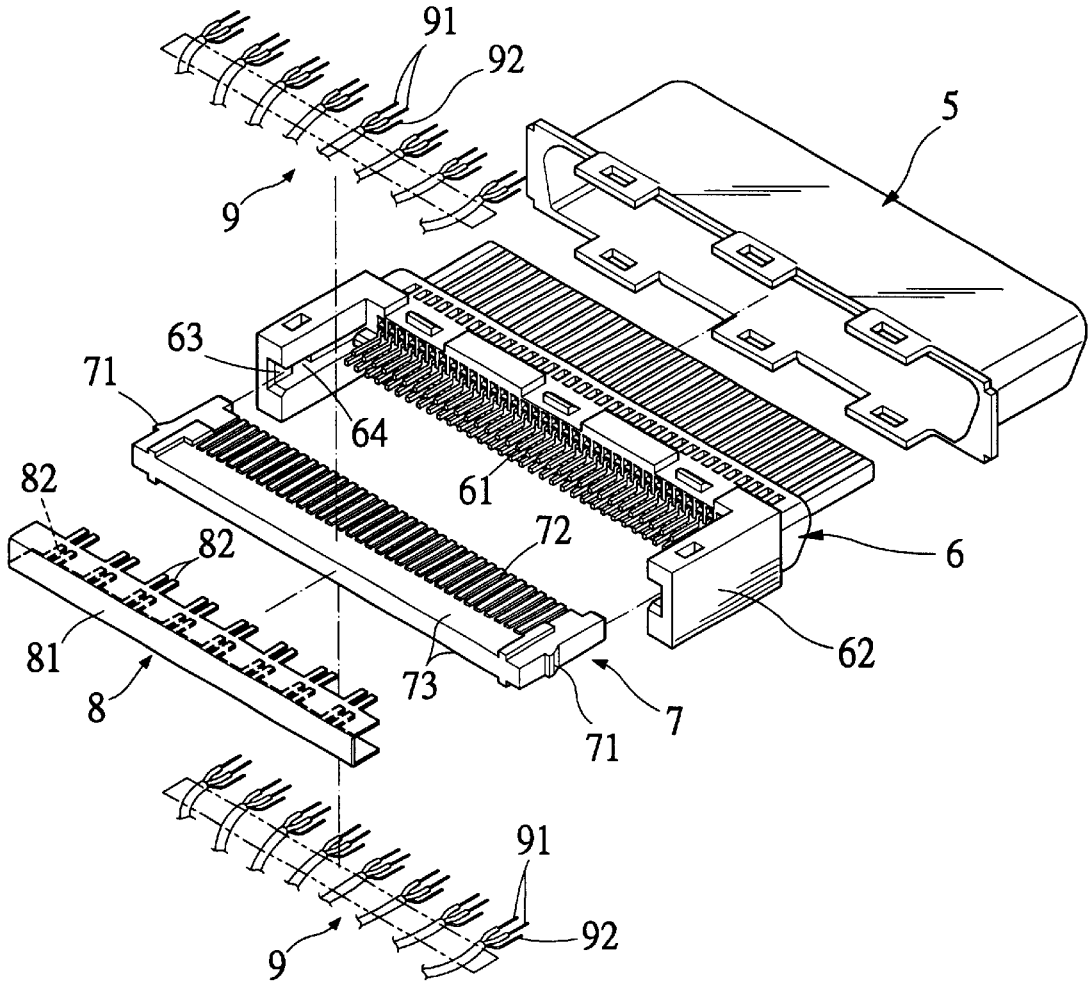
FIG. 2 is an exploded perspective showing the structure of a connector according to a first embodiment of the present invention.
Figure 3:
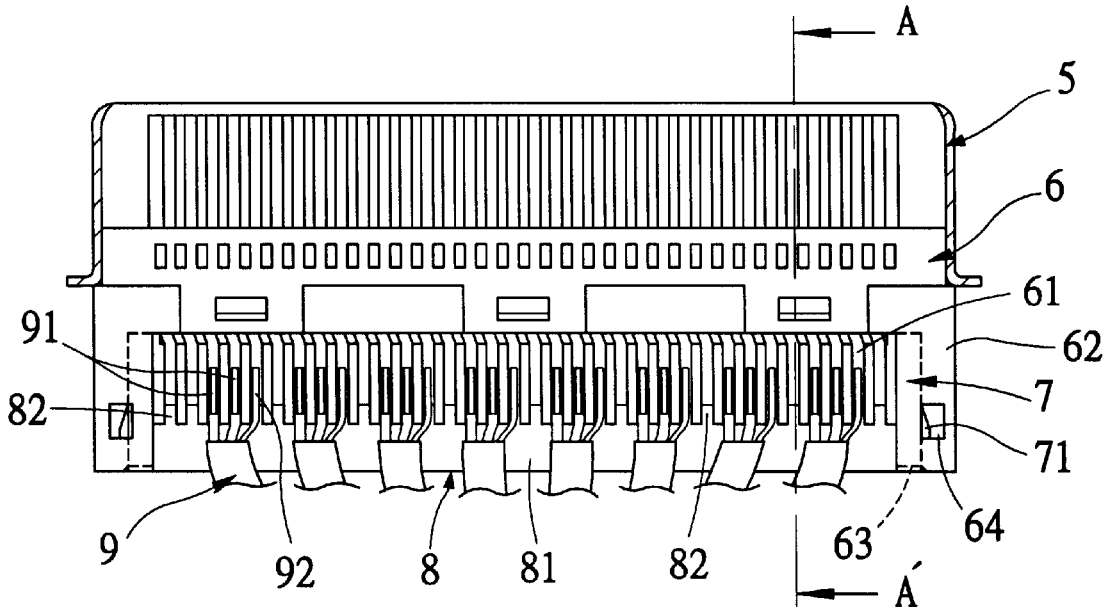
FIG. 3 is a partially sectional top plan view of the connector of FIG. 2 in an assembled state.

Please refer to FIGS. 2 and 3 that are exploded perspective and assembled top plan views, respectively, of a connector according to a first embodiment of the present invention. The connector mainly includes a steel case 5, a plastic body 6, an insertion plate 7, a common ground connection means 8, and more than one multiple-core cable 9. A front part of the plastic body 6 is externally covered by the steel case 5, and a rear part of the plastic body 6 has the insertion plate 7 connected thereto.

The plastic body 6 is provided at its rear part with an upper and a lower row of multiple connection terminals 61, and two rearward extended side walls 62. The connection terminals 61 on the upper row and the lower row are in a staggered arrangement. The side walls 62 are provided at their respective inner surface with a guide groove 63 each. And in each of the guide grooves 63 there is provided at a predetermined position a retaining hole 64 for holding the insertion plate 7 to the plastic body 6 between the two guide grooves 63.

The insertion plate 7 is provided at two lateral sides with two retaining projections 71 corresponding to the two retaining holes 64 on the plastic body 6, so that when the insertion plate 7 is guided by the guide grooves 63 to fully slide into the rear part of the plastic body 6, the retaining projections 71 engage into the retaining holes 64 to firmly locate the insertion plate 7 between the two side walls 62 of the plastic body 6. The insertion plate 7 is provided with upper and lower rows of multiple terminal slots 72 corresponding to the upper and lower rows of multiple connection terminals 61. When the insertion plate 7 is fully slid into the rear part of the plastic body 6 to locate between the two guide grooves 63, rear ends of the connection terminals 61 are separately seated in a corresponding terminal slot 72. The insertion plate 7 is further provided behind the upper and the lower rows of terminal slots 72 with upper and lower receiving recesses 73, respectively, both of which transversely extend a full width of the insertion plate 7 and electrically connect with rear ends of some of the terminal slots 72.

The common ground connection means 8 includes a main body 81 having a cross section close to a lying letter "n" with an opening thereof facing forward. The main body 81 is provided along upper and lower front edges thereof with two rows of multiple staggered common ground terminals 82. The main body 81 is so sized that it is suitable for fitly engaging its upper and lower walls with the upper and lower receiving recesses 73 of the insertion plate 7 with the common ground terminals 82 extending into some terminal slots 72 corresponding to these common ground terminals 82 to electrically contact with rear ends of the connection terminals 61 seated in these terminal slots 72.

The more than one multiple-core cable 9 each includes multiple information wires 91 and a ground wire 92. Alternatively, each multiple-core cable 9 may include multiple information wires 91 wrapped up in a ground net to reduce cost for wires and minimize sources causing noises interference. The ground wire 92 is individually welded to a corresponding common ground terminal 82 on the common ground connection means 8 and to a connection terminal 61 corresponding to that common ground terminal 82. The information wires 91 in one multiple-core cable 9 are welded to rear ends of the connection terminals 61 seated in the rest terminal slots 72. By this way, all the ground wires 92 are connected to the common ground connection means 8 to form one single ground wire.

In assembling the connector of FIG. 2, first assemble the insertion plate 7 to the plastic body 6 by inserting two lateral sides of the insertion plate 7 into the two guide grooves 63 of the plastic body 6 until the insertion plate 7 is fully slid forward to locate between the two side walls 62 of the plastic body 6. Then, assemble the main body 81 of the common ground connection means 8 to the receiving recesses 73 of the insertion plate 7, so that the common ground terminals 82 electrically connect with the connection terminals 61 on the plastic body 6. Thereafter, position the ground wire 92 of each multiple-core cable 9 in a corresponding terminal slot 72 to press against a connection terminal 6 and a common ground terminal 82 in that terminal slot 72 before the ground wire 92, the ground terminal 82 and the connection terminal 61 are welded together. The information wires 91 in each multiple-core cable 9 are separately positioned in the rest terminal slots 72 adjacent to the ground wire 92 and pressed against and welded to the connection terminals 6 in these terminal slots 72. Finally, cover the steel case 5 over the front part of the plastic body 6 to complete the assembling of the connector of the present invention.

Figure 4:
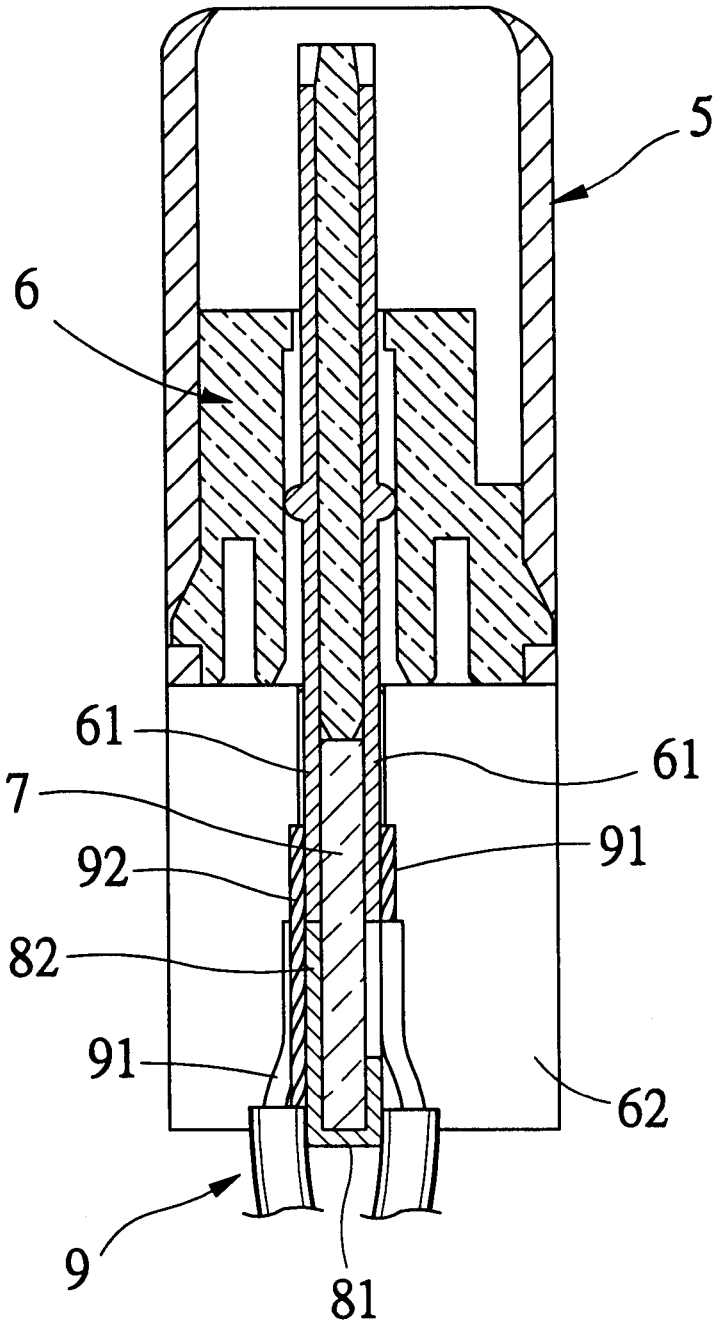
FIG. 4 is a sectional view taken on line A–A' of FIG. 3.

Please refer to FIG. 4 that is a sectional view taken on line A–A' of FIG. 3. When the insertion plate 7, the common ground connection means 8 and the plastic body 6 are assembled to form one unitary body, each of the terminal slots 72 has a connection terminal 61 seated therein. The common ground terminals 82 staggered at upper and lower walls of the common ground connection means 8 are also located in some of the terminal slots 72 to electrically connect to the connection terminals 61 and welded to the ground wire 92 in these terminal slots 72. In the terminal slots 72 that do not have common ground terminals 82 located therein, the common ground connection means 8 does not contact with the connection terminals 61 and the information wires 91 are directly welded to the connection terminals 61.

It is to be noted that the common ground terminals 82 of the common ground connection means 8 are not necessarily provided only at positions as shown in the illustrated drawings. The common ground terminals 82 may be located at positions corresponding to specific connection terminals 61 of the connector depending on actual need.

Figure 5:
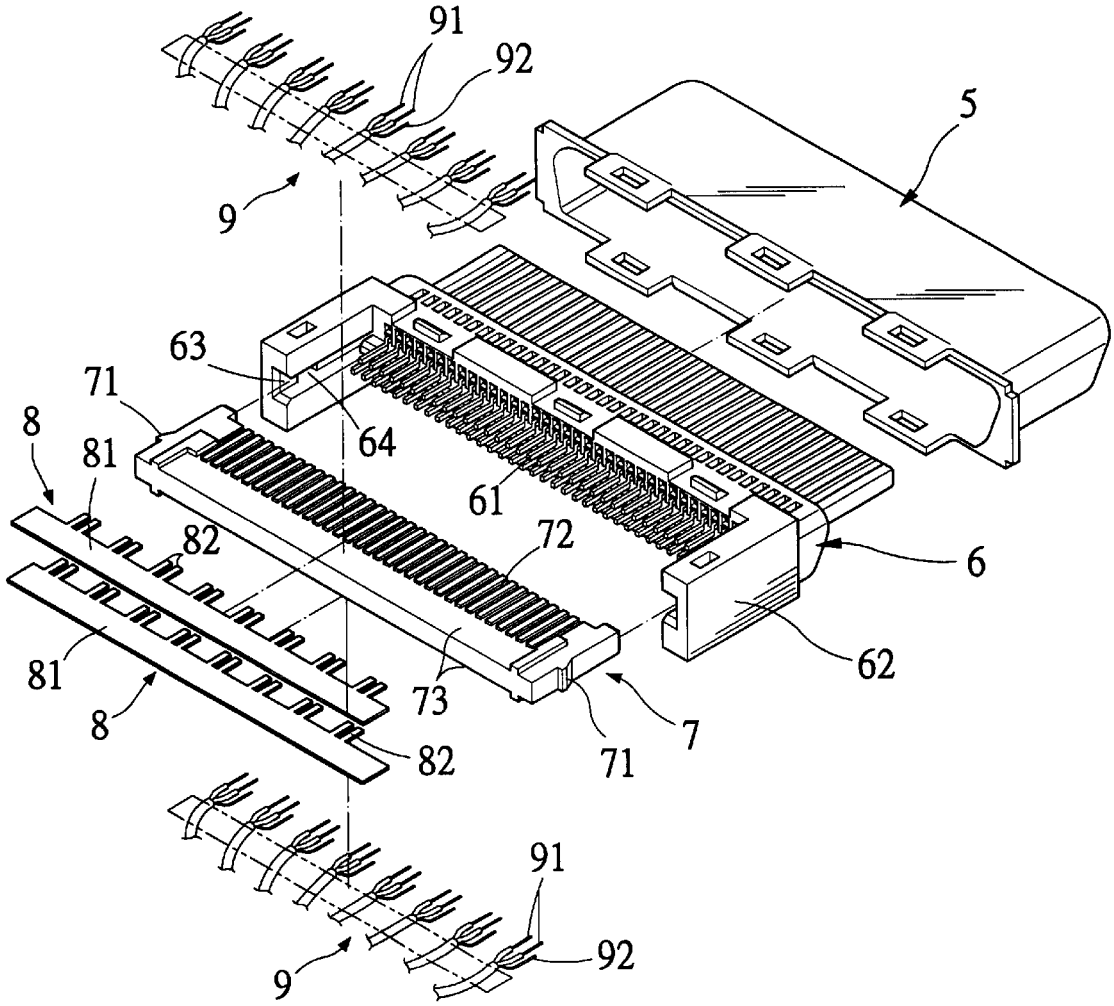
FIG. 5 is an exploded perspective of a connector according to another embodiment of the present invention.

And, the common ground connection means 8 is not necessarily to have a main body 81 having a cross section of a lying letter "n". In another embodiment of the present invention shown in FIG. 5, the common ground connection means 8 includes an upper and a lower main bodies 81' that are two long plates for separately locating in the upper and the lower receiving recesses 73. The two separate main bodies 81' also have staggered common ground terminals 82 and function just like the main body 81 in the first embodiment of the present invention.

The following are some advantages attributable to the special structure of the connector of the present invention:

1. With the common ground connection means 8, all ground wires maybe connected to the same one grounding surface to effectively attenuate noise surge and prevent noise interference.

2. By directly welding the multiple-core cables 9 to rear ends of the connection terminals 61, data transmission distance may be shortened to increase transmission speed.

3. By inserting the insertion plate 7 into the plastic body 6 to form a unitary body, the connector may have a reduced volume.

What is claimed is:

1. A connector comprising a plastic body, a front part of which being covered with a steel case and a rear part of which having an insertion plate connected thereto, said plastic body having two rearward extended side walls that are provided at an inner surface with a guide groove each, so that said insertion plate is connected to said plastic body by engaging two lateral sides into said two guide grooves, said insertion plate being provided at a front side with an upper and a lower row of multiple terminal slots in each of which a rear end of a connection terminal provided on the rear part of the plastic body is seated, said insertion plate being provided at a rear side with an upper and a lower receiving recess transversely extending across said insertion plate, and said upper and said lower receiving recesses being electrically connected with rear ends of some of said terminal slots at the front side of said insertion plate; said connector being characterized in that:

a common ground connection means is associated with said upper and said lower receiving recesses provided at the rear side of said insertion plate, said common ground connection means being provided at a front side with staggered upper and lower common ground terminals, said common ground terminals being separately located in some of said terminal slots of said insertion plate to electrically contact with rear ends of said connection terminals correspondingly seated in said some terminal slots; and that a plurality of multiple-core cables are separately connected to said insertion plate in such a manner that a ground wire in each of said multiple-core cables is connected to said some terminal slots that each has one said common ground terminal and one said connection terminal seated therein and other information wires in each of said multiple-core cables are connected to said terminal slots that each has only one said connection terminal seated therein;

whereby all said ground wires are electrically connected to said common ground connection means to form a common ground that effectively reduces noises and prevents noise interference with said connector.

2. A connector as claimed in claim 1, wherein said common ground connection means includes a main body having a cross section of a lying letter "n".

3. A connector as claimed in claim 1, wherein said common ground connection means includes two main bodies in the form of two long plates.

* * * * *